US006543530B2

(12) United States Patent
Watanabe

(10) Patent No.: US 6,543,530 B2
(45) Date of Patent: Apr. 8, 2003

(54) HEAT EXCHANGER HAVING AN IMPROVED PIPE CONNECTING STRUCTURE

(75) Inventor: Akimichi Watanabe, Maebashi (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/822,315

(22) Filed: Apr. 2, 2001

(65) Prior Publication Data

US 2001/0027860 A1 Oct. 11, 2001

(30) Foreign Application Priority Data

Apr. 6, 2000 (JP) ..... 2000-105045

(51) Int. Cl.[7] ..... F28F 9/02
(52) U.S. Cl. ..... 165/178; 165/153
(58) Field of Search ..... 165/152, 153, 165/128, 123

(56) References Cited

U.S. PATENT DOCUMENTS

| | | | | |
|---|---|---|---|---|
| 2,073,778 A | | 3/1937 | Boerger | |
| 2,229,207 A | | 1/1941 | Hansen | |
| 3,757,855 A | | 9/1973 | Kun et al. | |
| 3,993,126 A | | 11/1976 | Taylor | |
| 4,041,594 A | | 8/1977 | Chartet | |
| 4,234,041 A | | 11/1980 | Melnyk | |
| 4,547,943 A | | 10/1985 | Hoeffken | |
| 4,678,112 A | | 7/1987 | Koisuka et al. | |
| 4,860,823 A | * | 8/1989 | Noguchi | 165/153 |
| 5,042,577 A | * | 8/1991 | Suzumura | 165/153 |
| 5,297,624 A | | 3/1994 | Haussmann et al. | |
| 5,366,007 A | | 11/1994 | Hutto et al. | |
| 5,529,117 A | * | 6/1996 | Voss et al. | 165/144 |
| 5,540,278 A | | 7/1996 | Chiba et al. | |
| 5,630,326 A | * | 5/1997 | Nishishita et al. | 165/153 |
| 5,787,973 A | | 8/1998 | Kado et al. | |
| 6,220,343 B1 | * | 4/2001 | Ichiyanagi | 165/153 |

FOREIGN PATENT DOCUMENTS

| | | | | |
|---|---|---|---|---|
| JP | 336497 | | 2/1991 | |
| JP | 4-169794 A | * | 6/1992 | F28F/9/02 |

* cited by examiner

*Primary Examiner*—Allen Flanigan
(74) *Attorney, Agent, or Firm*—Baker Botts L.L.P.

(57) ABSTRACT

In a heat exchanger having a tank portion (4) defining a fluid inlet path (34) and a fluid outlet path (35) for conducting a heat exchange medium, an inlet portion (36) and an outlet portion (37) are formed integral with the tank portion to communicate with the fluid inlet path and the fluid outlet path, respectively. The inlet portion is adapted to connect with a fluid inlet pipe for introducing the heat exchange medium into the fluid inlet path. The outlet portion is adapted to connect with a fluid outlet pipe for discharging the heat exchange medium from the fluid outlet path.

3 Claims, 7 Drawing Sheets

HEAT EXCHANGER HAVING AN IMPROVED PIPE CONNECTING STRUCTURE

BACKGROUND OF THE INVENTION

This invention relates to a heat exchanger typically used in an automobile air conditioner and, in particular, to a pipe connecting structure included in the heat exchanger.

Recently, various heat exchangers have been developed and used in the automobile air conditioner. A typical one of the heat exchangers comprises a tank portion for defining fluid paths therein and a pipe connecting structure for connecting a fluid inlet pipe and a fluid outlet pipe with the tank portion to communicate with the fluid paths, respectively. The fluid inlet pipe is used for introducing a heat exchange medium into the tank portion. The fluid outlet pipe is used for discharging the heat exchange medium from the tank portion. The heat exchange medium serves as a working fluid while flowing through the fluid paths of the tank portion.

Referring to FIG. 1, description will be made as regards a heat exchanger in a related art. In FIG. 1, the heat exchanger is, for example, mounted in a vehicle and comprises a flange depicted at 101. The flange 101 is made of a single block body with cutting the block body to have an inlet portion 103 and an outlet portion 104 formed integral therewith. The flange 101 is fixed by brazing to a tank portion 102 through a flange stay 108. The tank portion 102 defines fluid inlet and fluid outlet paths 105 and 106 for conducting a heat exchange medium which may be a refrigerant known in the art. Ends of the inlet portion 103 and the outlet portion 104 are slightly inserted in the fluid inlet path 105 and the fluid outlet path 106 to communicate therewith, respectively. The other ends of the inlet portion 103 and the outlet portion 104 are for being connected with a fluid outlet pipe and a fluid inlet pipe which are not shown in FIG. 1. It is to be noted that the flange 101 is provided with a threaded hole 107 to engage a screw (not shown) used for fixing, for example, an expansion valve which is included in a cooling circuit known in the art.

Inasmuch as the flange 101 is made of the block body, i.e., an unhollow or solid member, it may be difficult to fully meet the demand for reduction in weight of the heat exchanger in order to improve the fuel efficiency. In addition, an increase in temperature will be insufficient upon brazing of the flange 101 to the tank portion 102 because the flange 101 is great in heat capacity. This may result in defective brazing.

In order to fabricate the flange 101, such single block body is subjected to cutting to form the inlet and the outlet portions 103 and 104. Therefore, it is difficult to reduce the material cost and the production cost. As a consequence, it would be impossible to achieve the reduction in cost of the heat exchanger using the flange 101 or an air conditioning apparatus using the heat exchanger.

SUMMARY OF THE INVENTION

It is therefore an object of this invention to provide a heat exchanger which is considerably reduced in weight and cost.

It is another object of this invention to provide a heat exchanger of the type described, which is improved in reliability and efficiency of brazing.

Other objects of the present invention will become clear as the description proceeds.

According to an aspect of the present invention, there is provided a heat exchanger which comprises a tank portion defining a fluid inlet path and a fluid outlet path for conducting a heat exchange medium, an inlet portion formed integral with said tank portion to communicate with said fluid inlet path, said inlet portion being adapted to connect with a fluid inlet pipe which is for introducing said heat exchange medium into said fluid inlet path, and an outlet portion formed integral with said tank portion to communicate with said fluid outlet path, said outlet portion being adapted to connect with a fluid outlet pipe which is for discharging said heat exchange medium from said fluid outlet path.

According to another aspect of the present invention, there is provided a heat exchanger which comprises a tank portion defining a fluid inlet path and a fluid outlet path for conducting a heat exchange medium, an inlet portion formed integral with said tank portion to communicate with said fluid inlet path, said inlet portion being adapted to connect with a fluid inlet pipe which is for introducing said heat exchange medium into said fluid inlet path, an outlet portion formed integral with said tank portion to communicate with said fluid outlet path, said outlet portion being adapted to connect with a fluid outlet pipe which is for discharging said heat exchange medium from said fluid outlet path, and a flange plate coupled to said inlet portion and said outlet portion for supporting said fluid inlet pipe and said fluid outlet pipe.

According to still another aspect of the present invention, there is provided a heat exchanger which comprises a tank portion defining a fluid inlet path and a fluid outlet path for conducting a heat exchange medium, an inlet portion formed integral with said tank portion to communicate with said fluid inlet path, said inlet portion being adapted to connect with a fluid inlet pipe which is for introducing said heat exchange medium into said fluid inlet path, an outlet portion formed integral with said tank portion to communicate with said fluid outlet path, said outlet portion being adapted to connect with a fluid outlet pipe which is for discharging said heat exchange medium from said fluid outlet path, a flange plate coupled to said inlet portion and said outlet portion for supporting said fluid inlet pipe and said fluid outlet pipe, and a flange stay placed between said flange plate and said tank portion, said flange plate being connected to said tank through said flange stay.

DESCRIPTION OF THE PREFERRED EMBODIMENTS:

With reference to FIGS. 2 through 5, description will be made as regards a heat exchanger according to a first embodiment of this invention.

Figure 1:
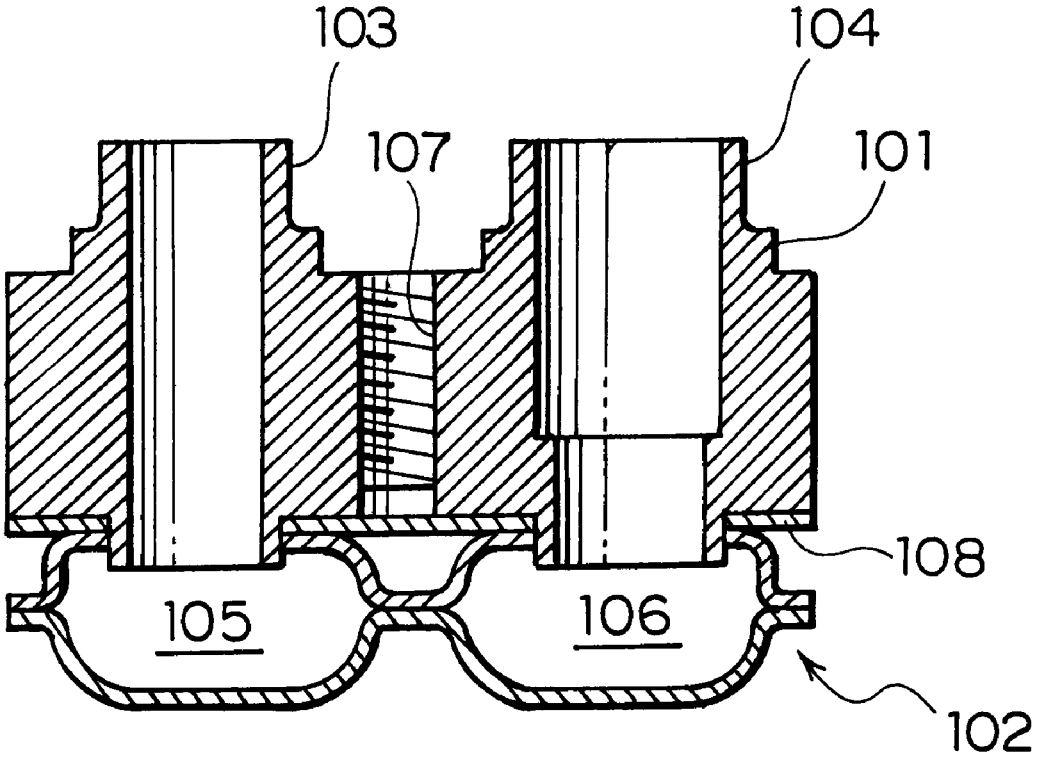
FIG. 1 RELATED ART
FIG. 1 is a sectional view of a main portion of a pipe connecting structure of a heat exchanger in a related art.
Figure 2:
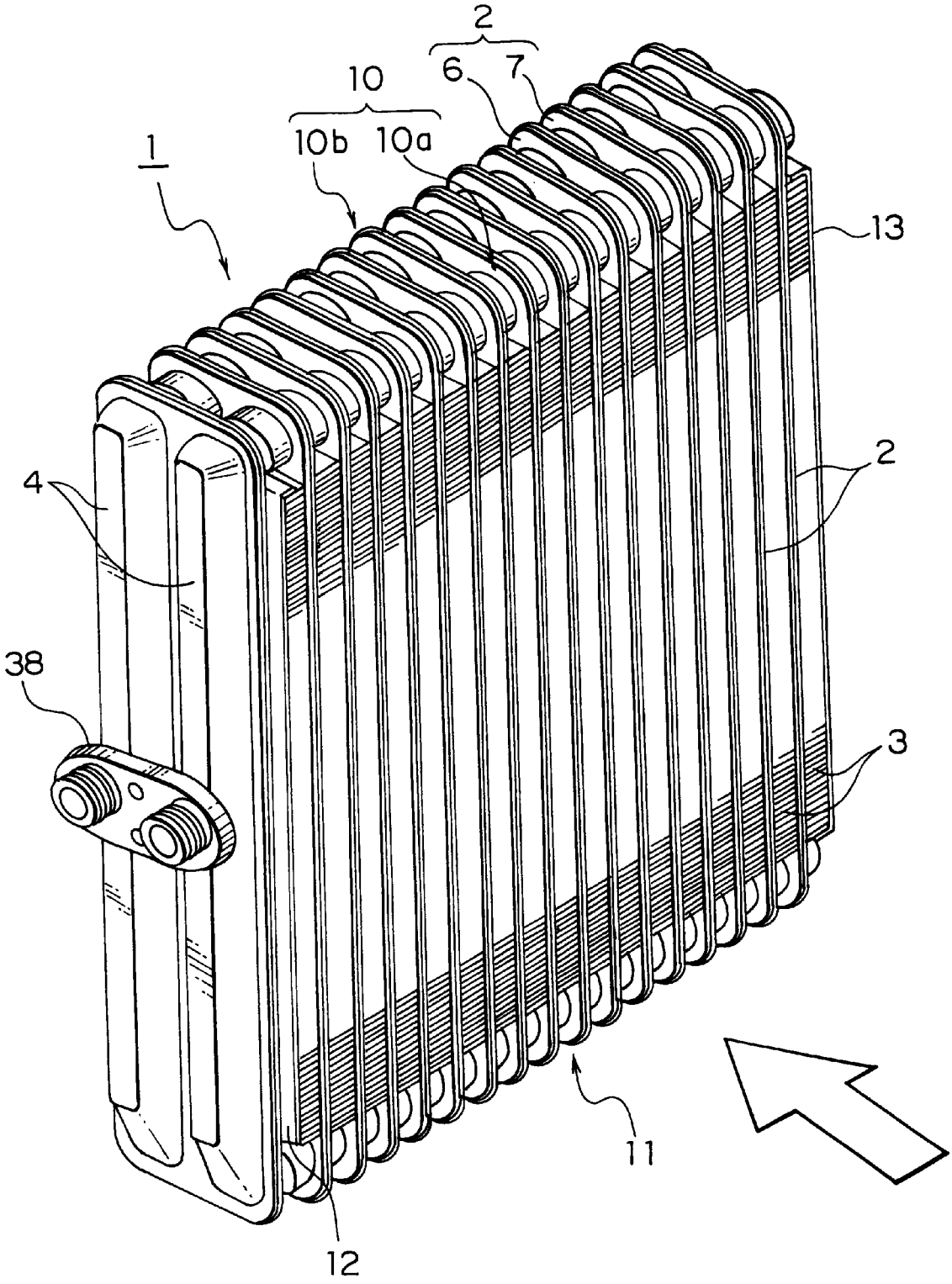
FIG. 2 is a perspective view of a heat exchanger according to a first embodiment of this invention.

At first referring to FIG. 2, the heat exchanger is designated by a reference numeral 1 and is illustrated as a laminated heat exchanger comprising a plurality of tubes 2 and a plurality of fins 3 alternately laminated or stacked to form a laminate portion. A pair of side plates 12 and 13 are attached on both sides of the laminate portion. The heat exchanger comprises a tank portion 4 disposed adjacent the side plate 12. The tank portion 4 defines a fluid inlet path and a fluid outlet path for conducting a heat exchange medium. A flange plate 38 is attached to the tank portion 4 in the manner which will later be described.

Figure 3:
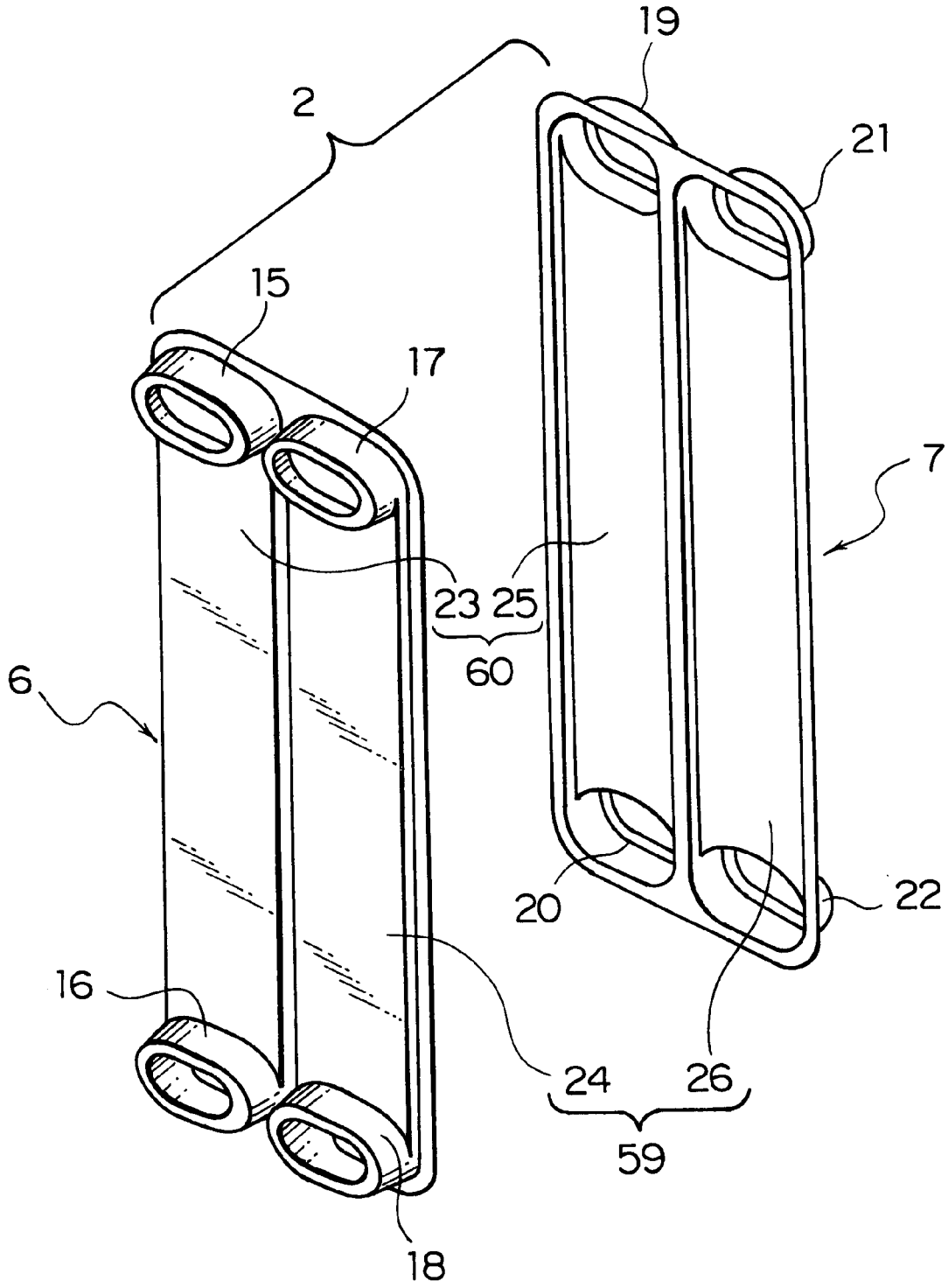
FIG. 3 is an exploded perspective view of a tube included in the heat exchanger of FIG. 2.

Referring to FIG. 3, each of the tubes 2 comprises a pair of shaped plates 6 and 7 coupled to each other. The shaped plate 6 is provided with a plurality of connecting protrusions 15, 16, 17, and 18. Likewise, the shaped plate 7 is provided with a plurality of connecting protrusions 19, 20, 21, and 22. The shaped plate 6 has a pair of expanding portions 23 and 24. Likewise, the shaped plate 7 has a pair of expanding portions 25 and 26. Inside each expanding portion, a plurality of ribs in contact with one another may be formed or a separate component such as an inner fin may be arranged in order to assure a sufficient strength against a tube inner pressure. When the shaped plates 6 and 7 are coupled to each other to form the tube 2, adjacent ones (15 and 19, 16 and 20, 17 and 21, 18 and 22) of the connecting protrusions of the tube 2 are connected to each other. Thus, fluid channels 59 and 60 are formed within the tube 2 to pass the heat exchange medium therethrough. By connecting the tubes 2 to one another, the connecting protrusions of the tubes 2 are connected in series to form upper and lower tanks 10 and 11 on upper and lower ends of the tube 2, respectively. The upper tank 10 comprises an upstream tank 10*a* and a downstream tank 10*b* positioned upstream and downstream with respect to an air flow direction, respectively. On the other hand, the lower tank 11 comprises an upstream tank 11*a* and a downstream tank 11*b* positioned upstream and downstream with respect to the air flow direction, respectively.

Figure 5:
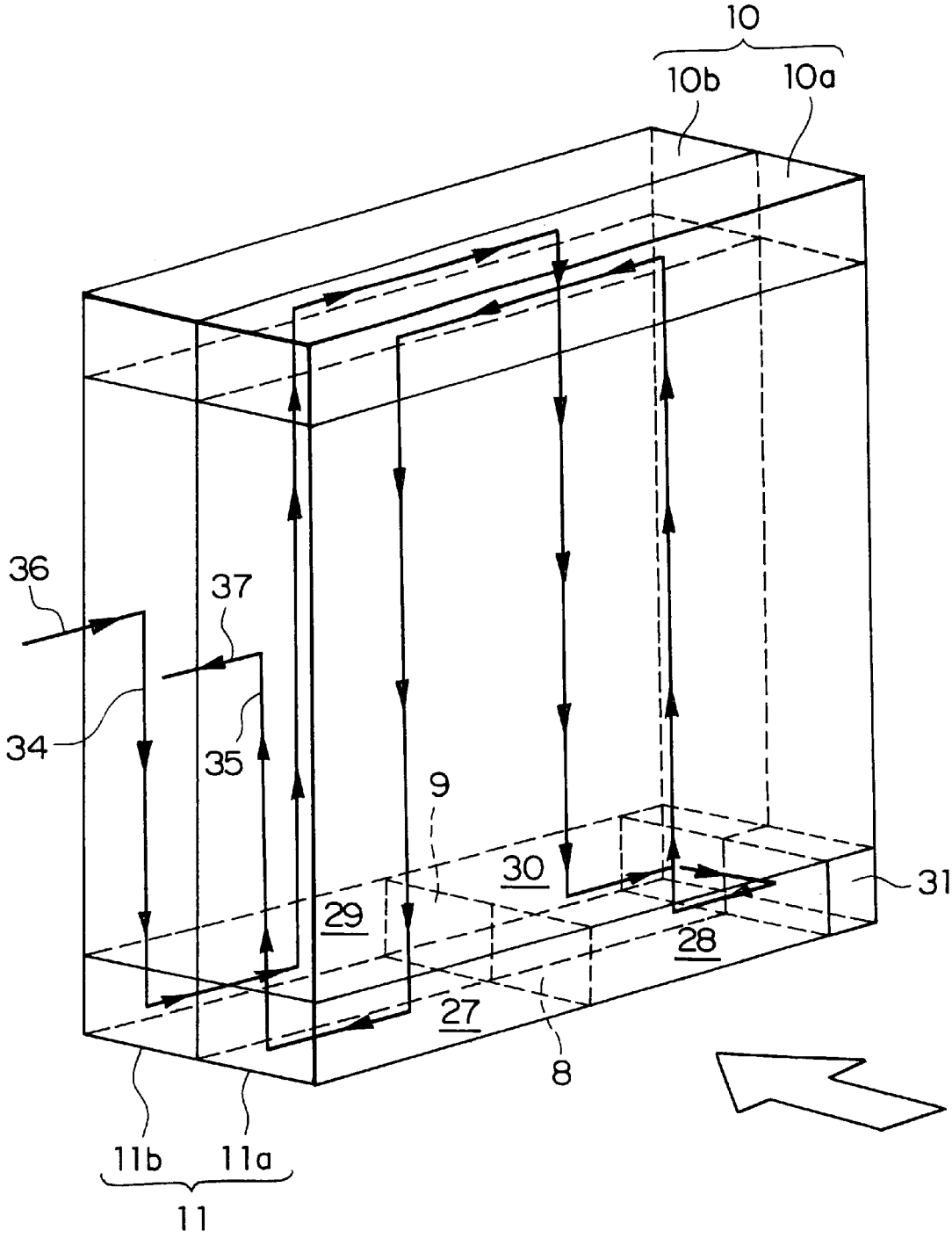
FIG. 5 is a perspective view showing a flow of a heat exchange medium in the heat exchanger illustrated in FIG. 2.

Referring to FIG. 5, the upstream tank 11*a* has an inner space divided by a partitioning plate 8 into chambers 27 and 28. Likewise, the downstream tank 11*b* has an inner space divided by a partitioning plate 9 into chambers 29 and 30. The upstream tank 11*a* and the downstream tank 11*b* communicate with each other through a header 31.

Figure 4:
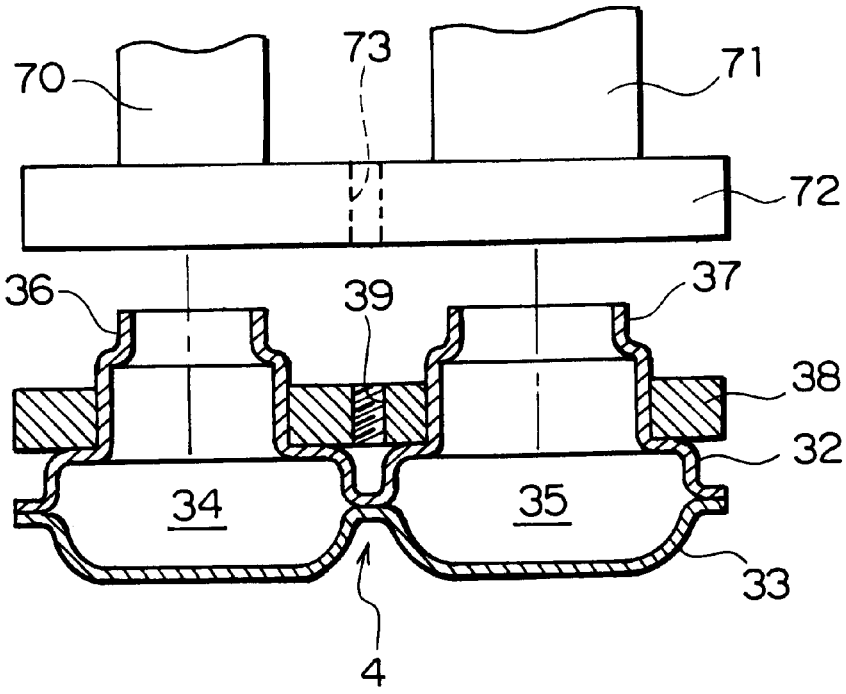
FIG. 4 shows an exploded sectional view of a connecting structure of the heat exchanger of FIG. 2 together with a fluid input pipe and a fluid output pipe.

Referring to FIG. 4, the tank portion 4 comprises a combination of tank plates 32 and 33 connected to each other and has the fluid inlet path 34 and the fluid outlet path 35 formed inside to introduce and discharge the heat exchange medium, respectively.

The tank plate 32 is provided with male terminals 36 and 37 integrally formed therewith and protruding outwards from the fluid inlet and the fluid outlet paths 34 and 35, respectively. The male terminal 36 communicates with the fluid inlet path 34 while the male terminal 37 communicates with the fluid outlet path 35. To the male terminals 36 and 37, a flange plate 38 having a threaded hole 39 is coupled. The flange plate 38 coupled to the male terminals 36 and 37 is brazed and connected to the tank plate 32.

The tank plates 32 and 33 of the tank portion 4 can easily be formed, for example, by pressing. The male terminals 36 and 37 integrally formed with the tank plate 32 can be formed simultaneously when the tank plate 32 is formed.

The male terminal 36 is connected to a fluid inlet pipe 70 while the male terminal 37 is connected to a fluid outlet pipe 71 for introduce and discharge the heat exchange medium, respectively. The fluid inlet and the fluid outlet pipes 70 and 71 are provided with a flange 72 formed at their ends. The flange 72 has a hole 73 to receive a screw (not shown) to be inserted therein. The flange 72 is fixed to the flange plate 38 by the screw so that the fluid inlet and the fluid outlet pipes 70 and 71 and the male terminals 36 and 37 are reliably connected, respectively. Thus, the male terminals 36 and 37 serve as pipe ends corresponding to terminals of the fluid inlet and the fluid outlet pipes 70 and 71, respectively. More particularly, the male terminal 36 is shaped to be fitted into the fluid inlet pipe 70 and is referred to as an inlet portion while the male terminal 37 is shaped to be fitted into the fluid outlet pipe 71 and is referred to as an outlet portion.

In the heat exchanger 1, the heat exchange medium is introduced through the male terminal 36 as the pipe end corresponding to the terminal of the fluid inlet pipe 70, passes through the heat exchanger as illustrated in FIG. 5, and is discharged through the male terminal 37 as the pipe end corresponding to the terminal of the fluid outlet pipe 71.

Since the male terminals 36 and 37 are integrally formed with the tank plate 32 of the tank portion 4, a conventional flange supporting or forming the pipe ends can be replaced by the flange plate 38 small in thickness and weight. In other words, the conventional flange produced by cutting the block body and having a large heat capacity can be replaced by the flange plate 38 which is small in thickness and weight and which can easily be produced by pressing. As a consequence, it is possible to reduce the weight of the heat exchange 1, to reduce the material cost and the production cost, and to improve the reliability and the efficiency of brazing.

Since each of the male terminals 36 and 37 can be formed by deep-drawing a part of the tank plate 32 during the step of forming the tank plate 32. Therefore, the production cost can be saved.

Figure 6:
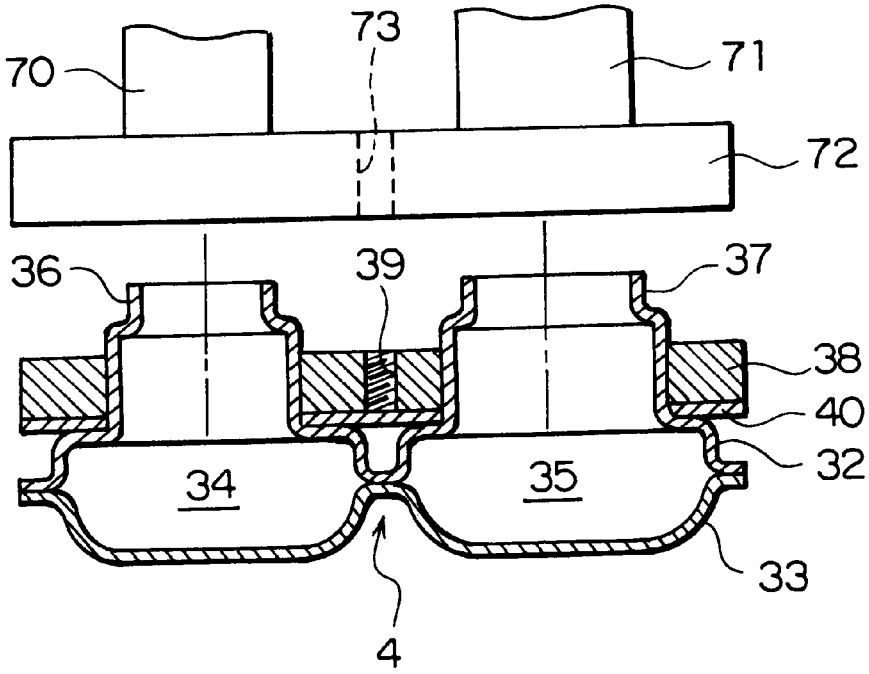
FIG. 6 is an exploded view similar to FIG. 4 but showing another connecting structure.

In FIG. 4, the flange plate 38 is directly brazed and connected to the tank plate 32. Alternatively, the flange plate 38 may be connected to the tank plate 32 through a flange stay 40, as illustrated in FIG. 6.

Figure 7:
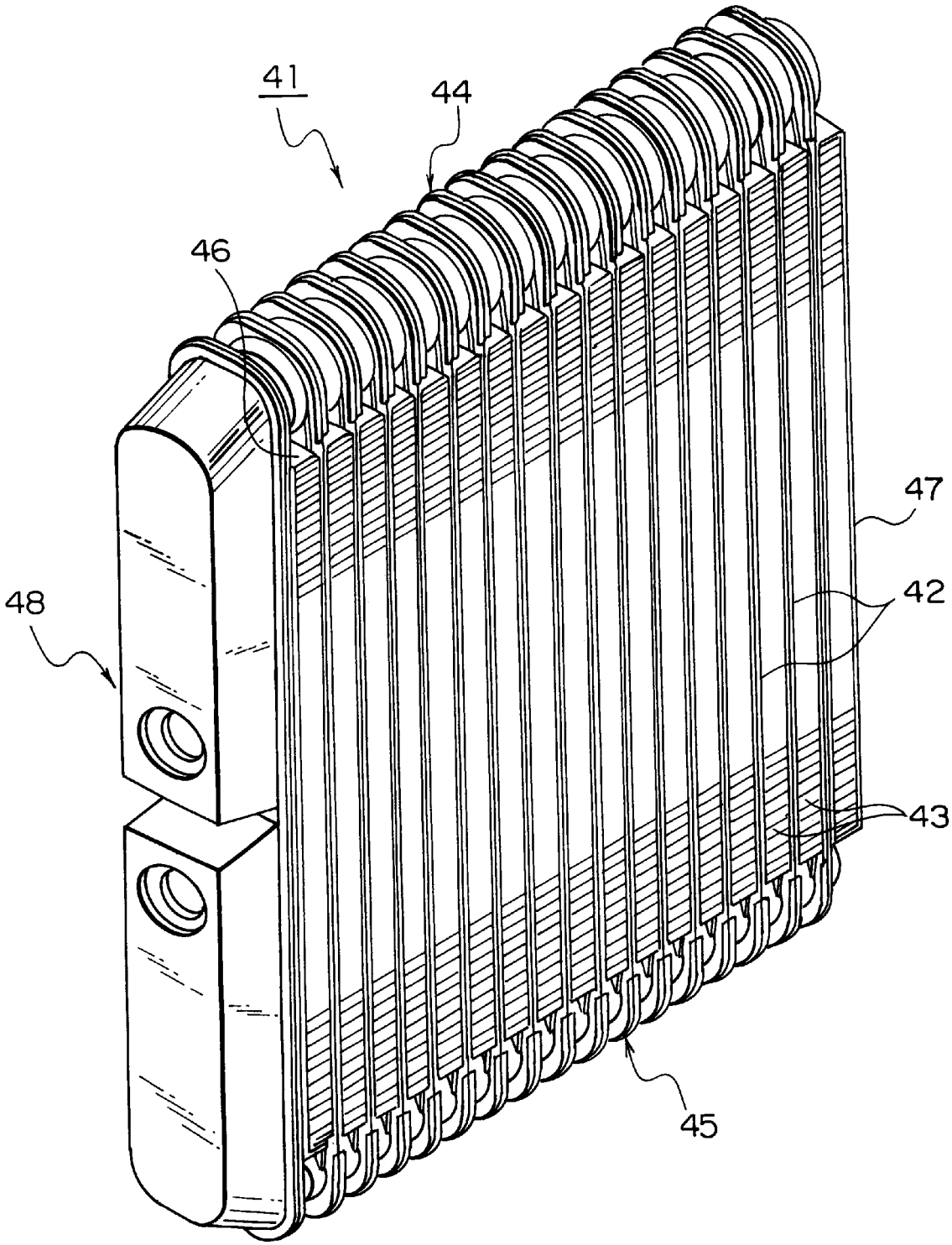
FIG. 7 is a perspective view of a heat exchanger according to a second embodiment of this invention.

Referring to FIG. 7, the description will be made of a pipe connecting structure for a heat exchanger according to a second embodiment of this invention. A heat exchanger 41 is a laminated heat exchanger comprising a plurality of tubes 42 and a plurality of fins 43 alternately laminated or stacked. On upper and lower ends of the tubes 42, an upper tank portion 44 and a lower tank portion 45 are formed, respectively. The heat exchanger 41 is provided with a pair of side plates 46 and 47 attached to the outside of the outermost fins 43.

Figure 8:
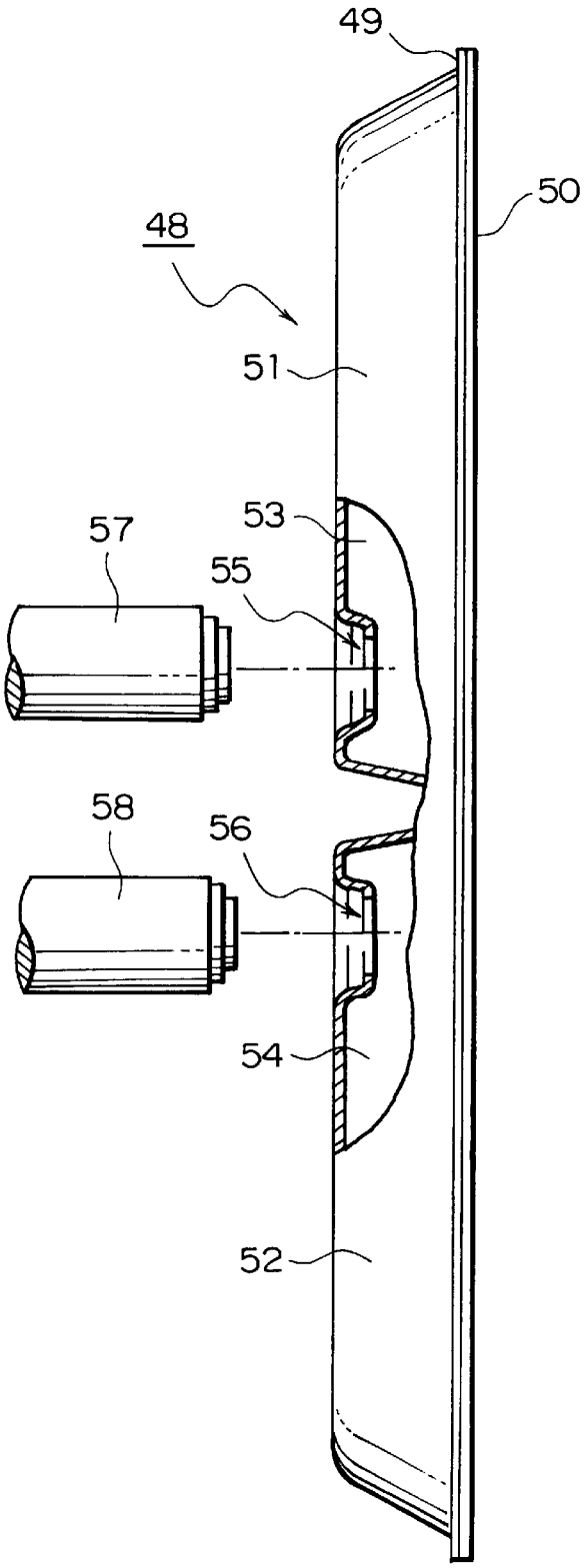
FIG. 8 shows an exploded sectional view of a connecting structure of the heat exchanger of FIG. 7 together with a fluid input pope and a fluid output pipe.

Outside the side plate 46, a tank portion 48 is disposed. As illustrated in FIG. 8, the tank portion 48 comprises a pair of tank plates 49 and 50. The tank plate 49 is provided with expanding portions 51 and 52. A combination of the expanding portion 51 and the tank plate 50 defines a fluid inlet path 53 for introducing a heat exchange medium. Likewise, a combination of the expanding portion 52 and the tank plate 50 defines a fluid outlet path 54 for discharging the heat exchange medium.

The expanding portions 51 and 52 are provided with female terminals 55 and 56 protruding inward into the fluid inlet and the fluid outlet paths 53 and 54, respectively. The female terminals 55 and 56 can be formed, for example, simultaneously when the tank plate 49 is formed by pressing, i.e., simultaneously when the expanding portions 51 and 52 are formed.

The female terminal 55 is opened in the fluid inlet path 53 while the female terminal 56 is opened in the fluid outlet path 54. The female terminal 55 is coupled with a fluid inlet pipe 57 to be inserted therein from the outside of the tank portion 48. Likewise, the female terminal 56 is coupled with a fluid outlet pipe 58 to be inserted therein. Thus, the female terminals 55 and 56 serve as pipe ends corresponding to terminals of the fluid inlet and the fluid outlet pipes 57 and 58, respectively. More particularly, the female terminal 55 is shaped to be fitted over the fluid inlet pipe 57 and is referred to as the inlet portion while the female terminal 56 is shaped to be fitted over the fluid outlet pipe 58 and is referred to as the outlet portion.

It is to be noted that the flange plate in the first embodiment can be omitted. In addition, the female terminals 55 and 56 as the pipe ends of the fluid inlet and the fluid outlet pipes 57 and 58 are integrally formed with the tank plate 49 of the tank portion 48. The flange plate can be omitted as mentioned above. Therefore, reduction in weight and cost can more effectively be achieved.

As described above, the pipe ends of the fluid inlet and the fluid outlet pipes are integrally formed with the tank of the heat exchanger. Therefore, it is possible to achieve a high-quality heat exchanger and a high-quality air conditioner which can fully respond to the demand for reduction in weight and cost and which can be improved in reliability and efficiency of brazing.

What is claimed is:

1. A heat exchanger comprising:

a tank portion defining a fluid inlet path and fluid outlet path for conducting a heat exchange medium;

an inlet portion formed integral with said tank portion to communicate with said fluid inlet path, said inlet portion being adapted to connect with a fluid inlet pipe which is for introducing said heat exchange medium into said fluid inlet path;

an outlet portion formed integral with said tank portion to communicate with said fluid outlet path, said outlet portion being adapted to connect with a fluid outlet pipe which is for discharging said heat exchange medium from said fluid outlet path, wherein said tank portion, said fluid inlet portion, and said outlet portion are formed from a single member; and a flange plate coupled to said inlet portion and said outlet portion for supporting said fluid inlet pipe and fluid outlet pipe, wherein said inlet portion and said outlet portion are formed through said flange plate.

2. The heat exchanger according to claim 1, wherein said inlet portion is shaped to fit into said fluid inlet pipe.

3. The heat exchanger according to claim 1, wherein said outlet portion is shaped to fit into said fluid outlet pipe.

* * * * *